US012478166B2

(12) United States Patent
Quennessen

(10) Patent No.: US 12,478,166 B2
(45) Date of Patent: Nov. 25, 2025

(54) RELOADABLE APPLICATOR SYSTEM FOR COSMETICS

(71) Applicant: Coty Inc., New York, NY (US)

(72) Inventor: Bernard Quennessen, Boonton, NJ (US)

(73) Assignee: Coty Inc., New York, NY (US)

( * ) Notice: Subject to any disclaimer, the term of this patent is extended or adjusted under 35 U.S.C. 154(b) by 0 days.

(21) Appl. No.: 18/717,673

(22) PCT Filed: Dec. 8, 2022

(86) PCT No.: PCT/US2022/081178
§ 371 (c)(1),
(2) Date: Jun. 7, 2024

(87) PCT Pub. No.: WO2023/108066
PCT Pub. Date: Jun. 15, 2023

(65) Prior Publication Data

US 2024/0407530 A1 Dec. 12, 2024

Related U.S. Application Data

(60) Provisional application No. 63/287,736, filed on Dec. 9, 2021.

(51) Int. Cl.
*A45D 34/04* (2006.01)
*A45D 34/00* (2006.01)

(52) U.S. Cl.
CPC ..... *A45D 34/046* (2013.01); *A45D 2034/005* (2013.01)

(58) Field of Classification Search
CPC ..... A45D 34/046; A45D 2034/005; A45D 34/045; A45D 40/265; A45D 40/267
(Continued)

(56) References Cited

U.S. PATENT DOCUMENTS 5,116,154 A * 5/1992 Fulkerson ..... A45D 34/045 401/129
6,164,857 A * 12/2000 Wolfarth-Brooks ..... A45D 34/045 401/126

(Continued)

FOREIGN PATENT DOCUMENTS

DE 8803479 5/1988
FR 2942117 8/2010

(Continued)

OTHER PUBLICATIONS

"International Application Serial No. PCT US2022 081178, Invitation to Pay Additional Fees mailed Mar. 13, 2023", 14 pgs.

(Continued)

*Primary Examiner* — David J Walczak
(74) *Attorney, Agent, or Firm* — Schwegman Lundberg & Woessner, P.A.

(57) ABSTRACT

Inventive embodiments disclosed herein include a reloadable applicator that includes a cartridge for containing a product; a cartridge neck wiper including inner threads configured to engage with outer threads on the cartridge; a wand comprising a proximal end and a distal end, wherein the proximal end terminates in an applicator for applying product; an inner cap attachable to the cartridge neck wiper; a spring push button comprising a spring and positioned within the inner cap wherein the distal end of the wand is retainable by the spring; and a cap configured to releasably retain the base. The cap can be sized to surround the inner cap when the cap is retaining the base.

11 Claims, 9 Drawing Sheets

(58) Field of Classification Search
USPC ..... 401/121, 122, 126–130
See application file for complete search history.

(56) References Cited

U.S. PATENT DOCUMENTS

| | | | | |
|---|---|---|---|---|
| 7,374,358 | B2 * | 5/2008 | Neuner | A45D 34/046 401/122 |
| 7,455,468 | B2 * | 11/2008 | Gueret | A45D 40/268 401/122 |
| 2006/0051155 | A1 * | 3/2006 | Delage | A45D 40/267 401/122 |

FOREIGN PATENT DOCUMENTS

| | | |
|---|---|---|
| WO | 2021063095 | 4/2021 |
| WO | 2023108066 | 6/2023 |

OTHER PUBLICATIONS

"International Application Serial No. PCT US2022 082542, International Search Report mailed May 8, 2023", 4 pgs.
"International Application Serial No. PCT US2022 082542, Written Opinion mailed May 8, 2023", 11 pgs.
"International Application Serial No. PCT US2022 081178, International Preliminary Report on Patentability mailed Jun. 20, 2024", 13 pgs.

* cited by examiner

RELOADABLE APPLICATOR SYSTEM FOR COSMETICS

CLAIM OF PRIORITY

This patent application is a U.S. National Stage Filing under 35 U.S.C. 371 from International Application No. PCT/US2022/081178, filed on 8 Dec. 2022, and published as WO 2023/108066 on 15 Jun. 2023, which application claims the benefit of priority to U.S. Application Ser. No. 63/287,736, filed Dec. 9, 2021, which are incorporated by reference herein in their entirety.

FIELD

Inventive embodiments disclosed herein relate to a reloadable applicator system for cosmetics.

BACKGROUND

A priority of convenience of single use disposable consumer products over environmental sustainability has led to concerns about single use plastics and a consumer demand for sustainable packaging solutions.

SUMMARY

Inventive embodiments disclosed herein include a reloadable applicator that includes a cartridge for containing a product; a cartridge neck wiper including inner threads configured to engage with outer threads on the cartridge; a wand comprising a proximal end and a distal end, wherein the proximal end terminates in an applicator for applying product; an inner cap attachable to the cartridge neck wiper; a spring push button comprising a spring and positioned within the inner cap wherein the distal end of the wand is retainable by the spring; and a cap configured to releasably retain the wand between the base. The cap can be sized to surround the inner cap when the cap is retaining the base.

DETAILED DESCRIPTION

In describing and claiming the invention, the following terminology will be used in accordance with the definitions set forth below. Unless defined otherwise, all technical and scientific terms used herein have the same meaning as commonly understood by one of ordinary skill in the art to which this invention belongs. Any methods and materials similar or equivalent to those described herein can be used in the practice or testing of the present invention. Specific and preferred values listed below for substituents, and ranges are for illustration only; they do not exclude other defined values or other values within defined ranges for the radicals and substituents.

Definitions

As used herein, the articles "a" and "an" refer to one or to more than one, i.e., to at least one, of the grammatical object of the article. By way of example, "an element" means one element or more than one element.

The term "about," as used herein, means approximately, in the region of, roughly, or around. When the term "about" is used in conjunction with a numerical range, it modifies that range by extending the boundaries above and below the numerical values set forth. In general, the term "about" is used herein to modify a numerical value above and below the stated value by a variance of 20%.

The term "apply" or "application," as used in reference to a composition, means to apply or spread the compositions of the present invention onto keratinous tissue such as the epidermis.

The terms "comprises," "comprising," and the like can have the meaning ascribed to them in U.S. Patent Law and can mean "includes," "including" and the like. As used herein. "including" or "includes" or the like means including, without limitation.

As used herein, the terms "include", "includes" and "including" are meant to be non-limiting.

In the present patent application, the term "plastic" is synonymous with "polymer" and refers to a compound, formed during a chemical reaction by linking several monomers (i.e. more than two monomers) of the same or different kind together via covalent bonding, wherein the resulting polymer can differ in its degree of polymerization, molecular weight distribution and chain length respectively. Hence, a plastic or polymer according to the present invention is a compound, comprising in its molecular structure at least one repeating unit, which was integrated in the polymer structure during polymer synthesis by repeatedly linking monomers together via covalent bonds to form said polymer structure. The number average molecular weight is preferably at least 250 g/mol, more preferably at least 1,000 g/mol.

The term "polymer" includes homopolymers, copolymers, block-copolymers and oligomers.

As used herein, the term "consumer" means both the user of the composition and the observer nearby or around the user.

Description

Figure 1:
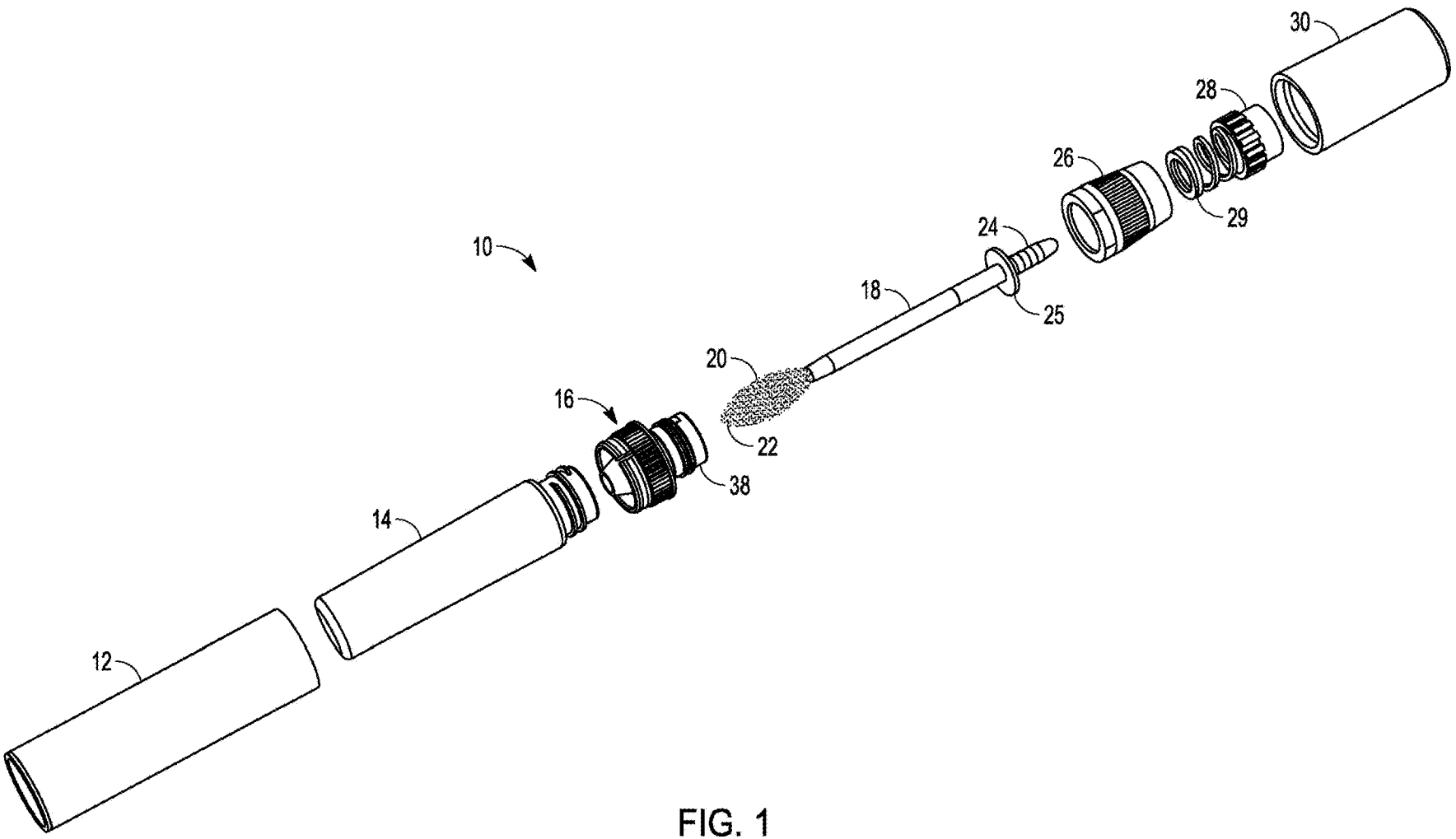
FIG. 1 is an exploded perspective view of a cosmetic reloadable system.

Embodiments disclosed herein include a reloadable applicator, illustrated generally at 10 in FIG. 1. The reloadable applicator includes a replaceable cartridge 14 for containing a liquid product, which is not shown; a cartridge neck wiper 16 attached to the replaceable cartridge 14; a wand 18 that includes a proximal end 22 and a distal end 24, wherein the proximal end terminates in a replaceable applicator for applying liquid product and the distal end terminates in a notched end having a concentric ring 25; an inner cap 26 attachable to the cartridge neck wiper 16; a spring push button 28 that includes a spring 29, the spring push button 28 positioned within the inner cap 26 wherein the distal end 24 of the wand 18 is retainable by the spring push button 28; and a cap 30 that can releasably retain the base 12.

Figure 9:
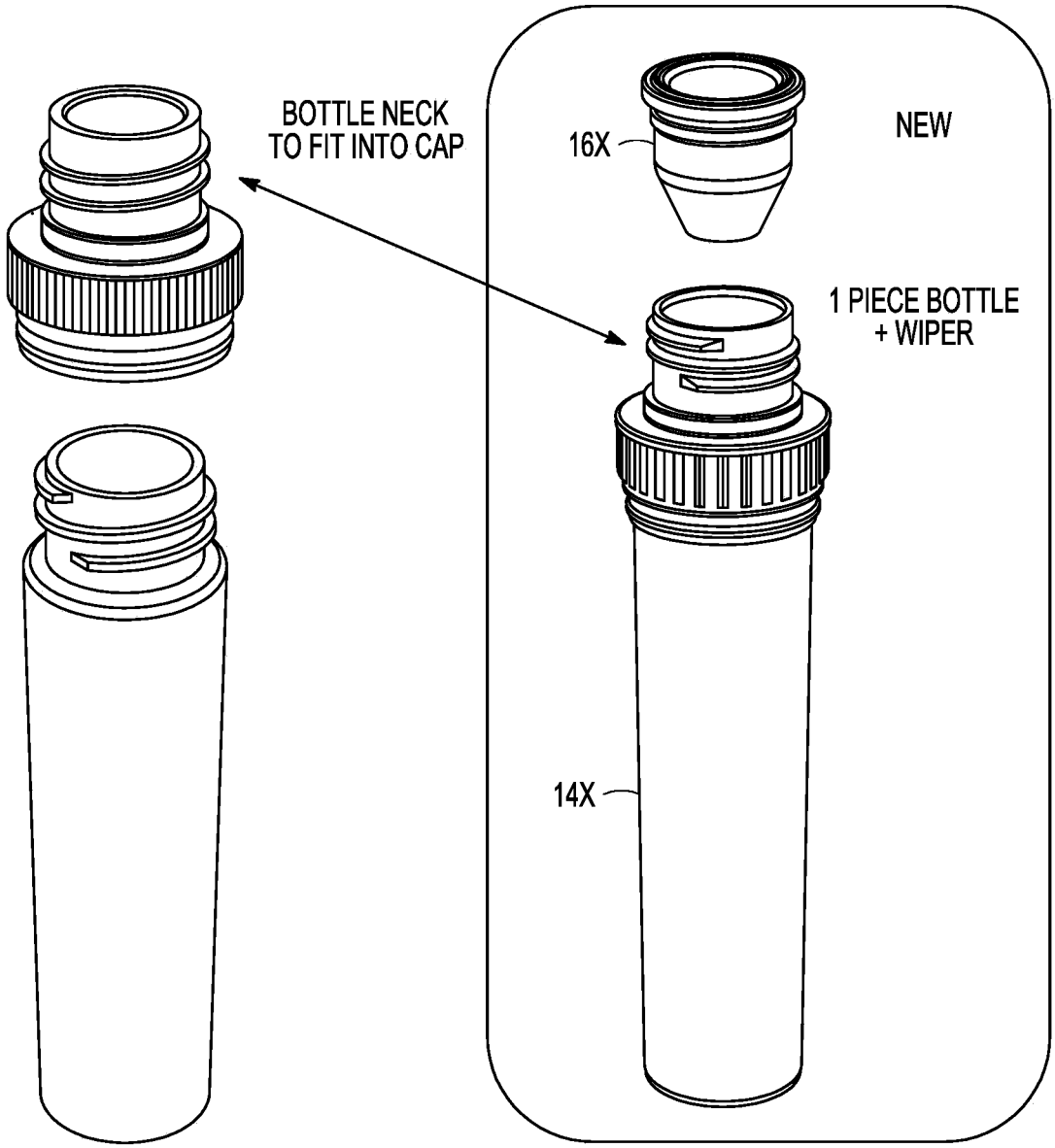
FIG. 9 is a perspective view of a one-piece cartridge and wiper.

The reloadable applicator system enables recycling and reusing at least a portion of the applicator system such as the base 12, cartridge neck-wiper 16, and the cap components 26 and 30. For some embodiments, the wand 18 is also recyclable. Thus, the single use components are limited to the cartridge bottle 14 and applicator 22. For some embodiments, the cartridge neck-wiper 16X and cartridge 14X, shown in FIG. 9, form a single unit.

For some embodiments disclosed herein, the bottle cartridge 14 is not single use but is both reloadable and refillable. Product, which is not shown, is contained within the cartridge 14. The reusability of the cartridge 14 renders the product more sustainable by reducing waste because the cartridge, once empty of product, is replaced with a new cartridge 14 having a new product charge. Presently, the entire applicator system is discarded once the product has been used.

For some embodiments, the reloadable applicator system is used by consumers for application of cosmetics, such as mascara, lip gloss, liquid concealer, and liquid lip color.

The system 10 includes the removable cartridge bottle 14 and a separable neck/wiper 16 inserted into a body/base. The cartridge bottle 14 and neck/wiper 16 are reversibly attachable to each other by threads, shown for the cartridge bottle at 34. The cartridge 14 is replaceable when empty by simply separating the threaded connection of the cartridge bottle 14 from the cartridge neck-wiper 16 and pushing through an open bottom of the body/base 12. When the empty cartridge is removed, a new, filled cartridge is inserted through the top opening of the body/base 12 and is snapped into place in the base. The new or recharged cartridge bottle 14 is threadedly attached to the cartridge neck-wiper 16.

Figure 4:
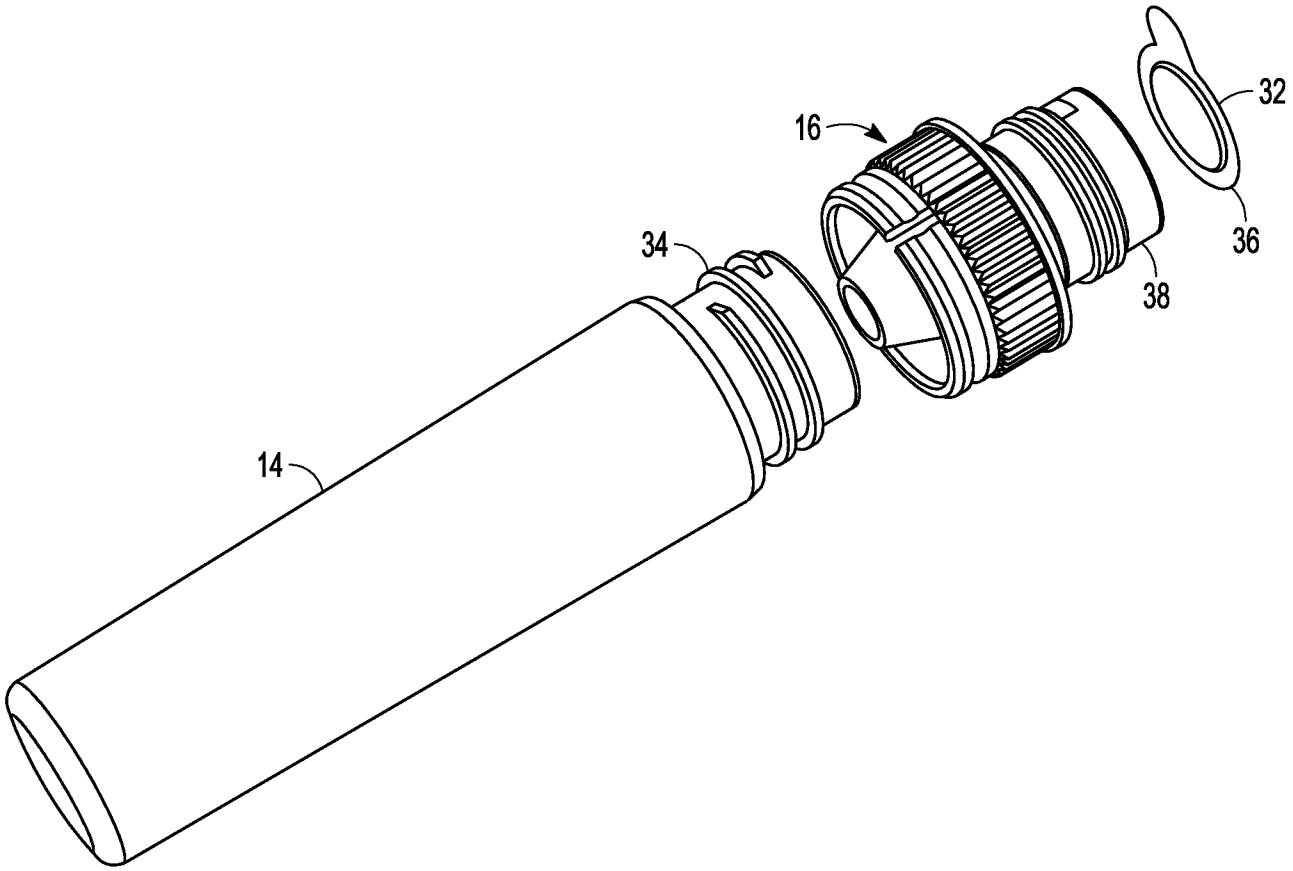
FIG. 4 is a perspective exploded view of the cartridge bottle, cartridge neck-wiper and heat seal of the cosmetic reloadable system of FIG. 1.

The cartridge neck wiper 16 is shown in greater detail in FIGS. 4 and 5. A heat seal 36, for closing and tamper-proofing, is positioned on a distal end 38 of the cartridge neck-wiper 16. The neck-wiper 16 has several functions. A first function is reversible attachment with the cartridge bottle 14. A second function is reversible attachment to the base 12. A third function is to seal the cartridge bottle 14 with the seal 36. A fourth function is providing a structure for wiping the applicator 22 of any excess product before application by a consumer.

Figure 5D:
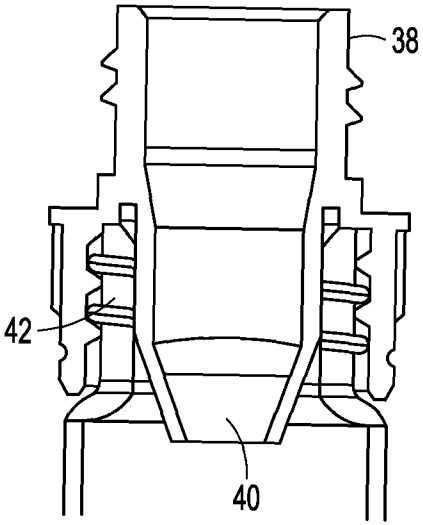
FIGS. 5C and 5D are a cross sectional view of the cartridge bottle, threaded cartridge bottle top, cartridge neck-wiper and heat seal of the cosmetic reloadable system of FIG. 1, wherein the cartridge neck-wiper is attached to the cartridge bottle.
Figure 5C:
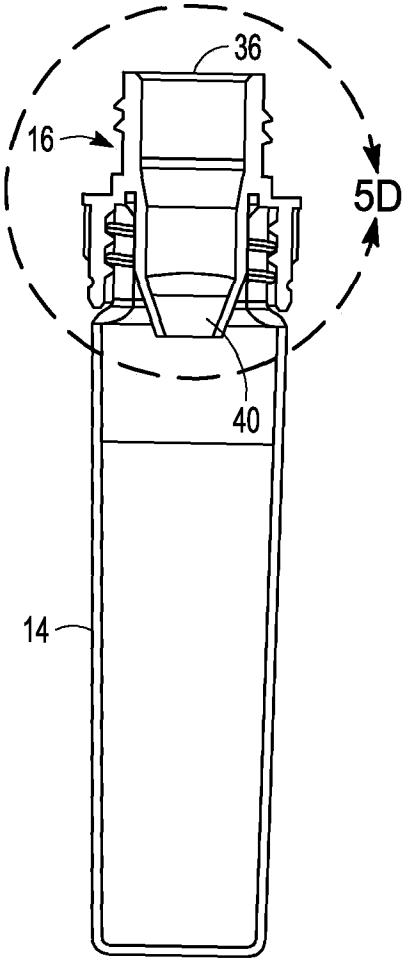
Figure 5B:
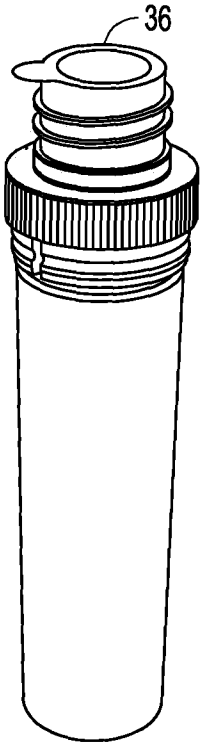
FIG. 5B is a perspective view of the cartridge bottle, threaded cartridge bottle top, cartridge neck-wiper and heat seal of the cosmetic reloadable system of FIG. 1, wherein the cartridge neck-wiper is attached to the cartridge bottle.
Figure 5A:
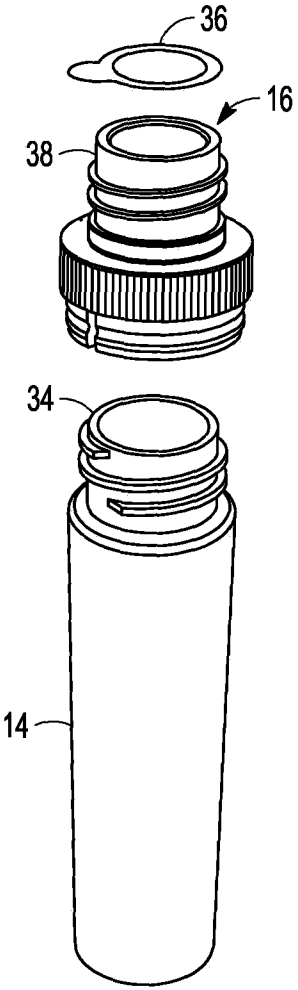
FIG. 5A is a perspective exploded view of the cartridge bottle, threaded cartridge bottle top, cartridge neck-wiper and heat seal of the cosmetic reloadable system of FIG. 1.

FIG. 5A shows external threads 34 at a neck of the cartridge bottle 14 that are engageable with internal threads, not shown, in the cartridge neck wiper 16. FIG. 5B shows the cartridge bottle 14 attached to the cartridge neck-wiper 16. Atop the cartridge neck wiper 16 is the heat seal 36. This engagement is shown in cross-section in FIG. 5C. FIG. 5C also shows a funnel 40 at a base of the cartridge neck-wiper 16, for removing excess product from the applicator 20 before application by a consumer. FIG. 5C shows that the single piece cartridge neck wiper 16 is easily separable from the cartridge bottle 14 to facilitate cleaning and reuse of the cartridge neck-wiper 16. Inner threads on the inner cap 26 can engage outer threads 38 on the cartridge neck wiper 16. Outer threads on the cartridge 14 can engage inner threads on the cartridge neck wiper 16. FIG. 5D also shows an inner chimney 42 that seals with the cartridge bottle 14 inside the neck diameter of the cartridge bottle 14.

The wand/rod applicator 18 is snapped into the inner cap 26 and is removable by pushing down on the push button 28 at the top of the cap 30 in order to prevent the consumer from removing the wand by pulling on it and getting product on his or her fingers. For some embodiments, the applicator is separable from the wand rendering the applicator disposable and the wand recyclable.

For some embodiments, the base/body 12 is made of plastic. For some embodiments, the cartridge bottle 14 is made of glass or plastic or aluminum. For these embodiments, the cartridge bottle is recyclable. For some embodiments, the applicator 20 includes a doe-foot structure and has a ceramic or metal or plastic tip. The cartridge neck-wiper 16, wand/rod 18, spring push-button 28, inner cap 26 and cap 30 are made of plastic and are not single use.

Figure 2C:
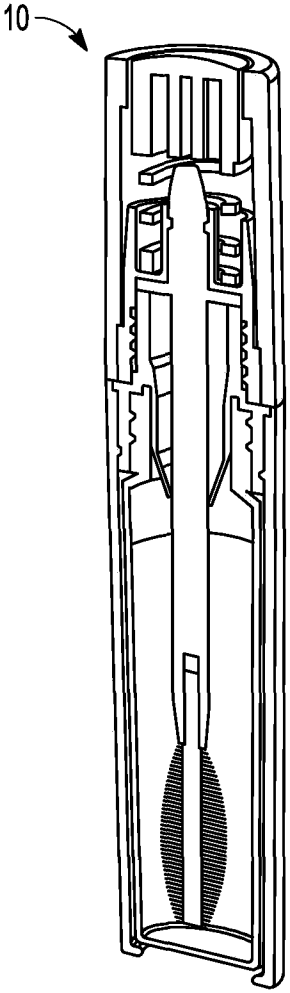
FIG. 2C shows a perspective cross-sectional view of the cosmetic reloadable system of FIG. 1.
Figure 2B:
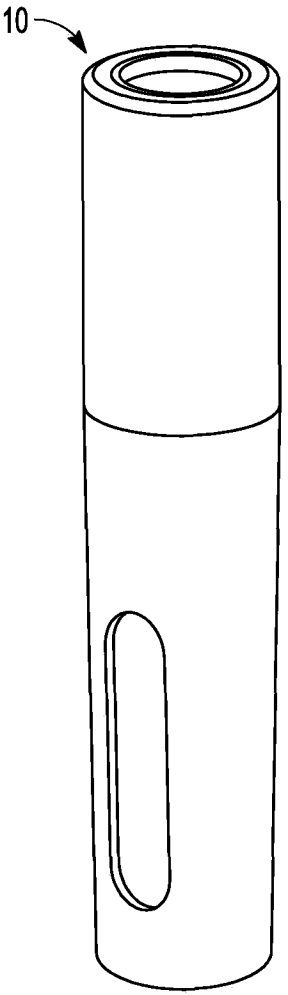
FIG. 2B shows a perspective view of the cosmetic reloadable system of FIG. 1, shown in a second view.
Figure 2A:
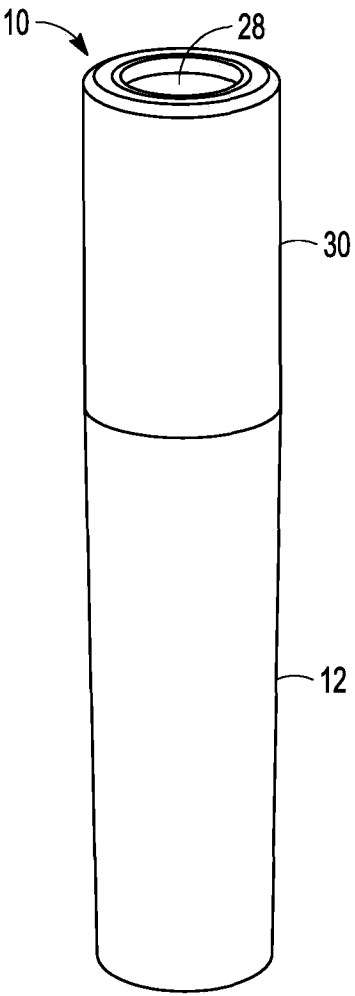
FIG. 2A is a perspective view of the cosmetic reloadable system of FIG. 1, showing a first view.

A rear view of the refillable applicator system 10 is shown is shown in FIG. 2A. The base 12, cap 30 and spring push-button 28 are shown in FIG. 2A. A front view of the refillable applicator system 10 is shown in FIG. 2B. FIG. 2C shows a cross-sectional view of the refillable applicator system.

Figure 3D:
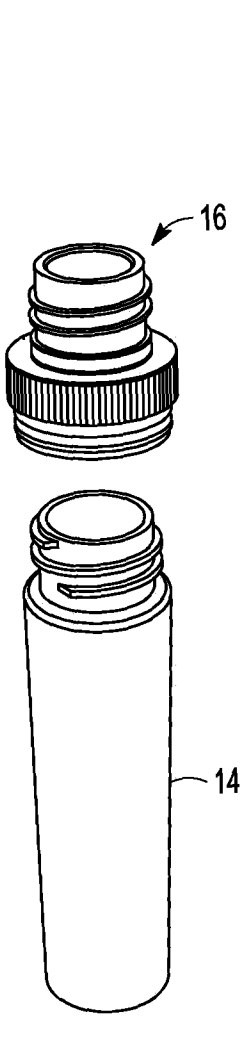
FIG. 3D is a perspective view of the cartridge bottle and cartridge neck-wiper of the cosmetic reloadable system of FIG. 1.
Figure 3C:
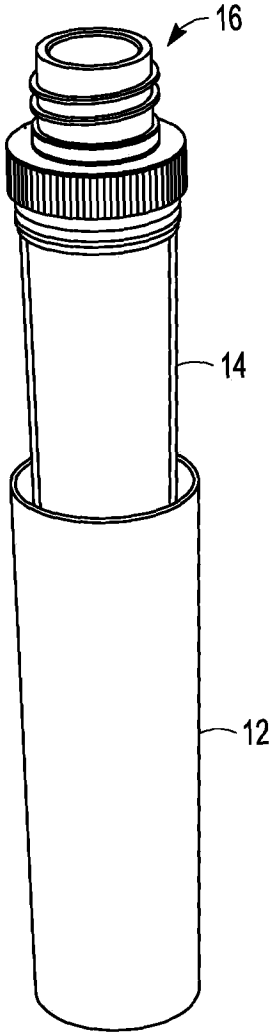
FIG. 3C is a perspective view of the cartridge bottle positioned within a base of the cosmetic reloadable system of FIG. 1, wherein a cartridge neck-wiper is attached to the cartridge bottle.
Figure 3B:
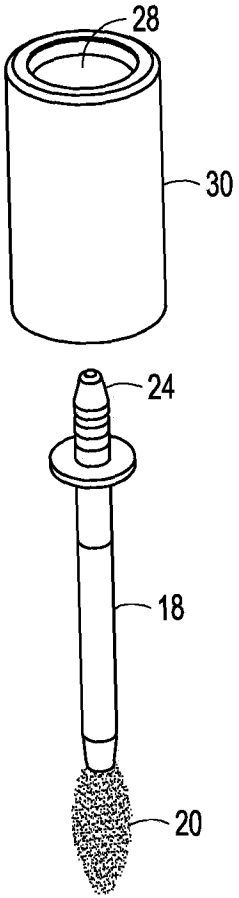
FIG. 3B is a perspective view of an applicator, wand, and cap for the cosmetic reloadable system of FIG. 1.
Figure 3A:
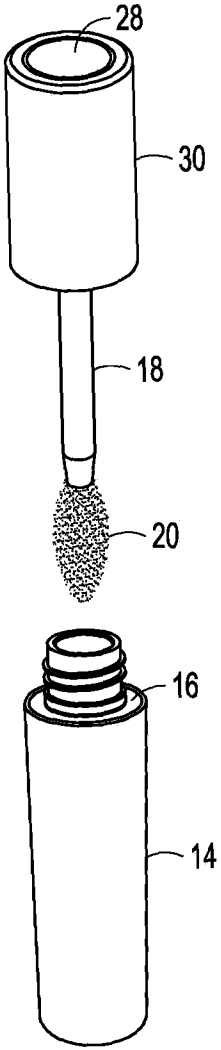
FIG. 3A is a perspective view of an applicator, applicator wand attached to a cap and cartridge bottle of the cosmetic reloadable system of FIG. 1.

A perspective view of the wand/rod 18 and applicator 20 attached to the cap 30 is shown in FIG. 3A. The applicator 20 is positioned for insertion into the cartridge bottle 14, through the cartridge neck-wiper 16. The spring push button 28 is shown in an unengaged position. In FIG. 3B, the spring push button 28 is engaged by a consumer pressing down at the top of the cap 30. Engaging the push button 28 releases the wand/rod 18 at its distal end 24. FIG. 3C shows the cartridge bottle 14, disengaged from the base 12. The cartridge bottle 14 is attached to the cartridge neck-wiper 16. FIG. 3D shows the cartridge bottle 14 detached from the cartridge neck wiper 16.

Figure 6:
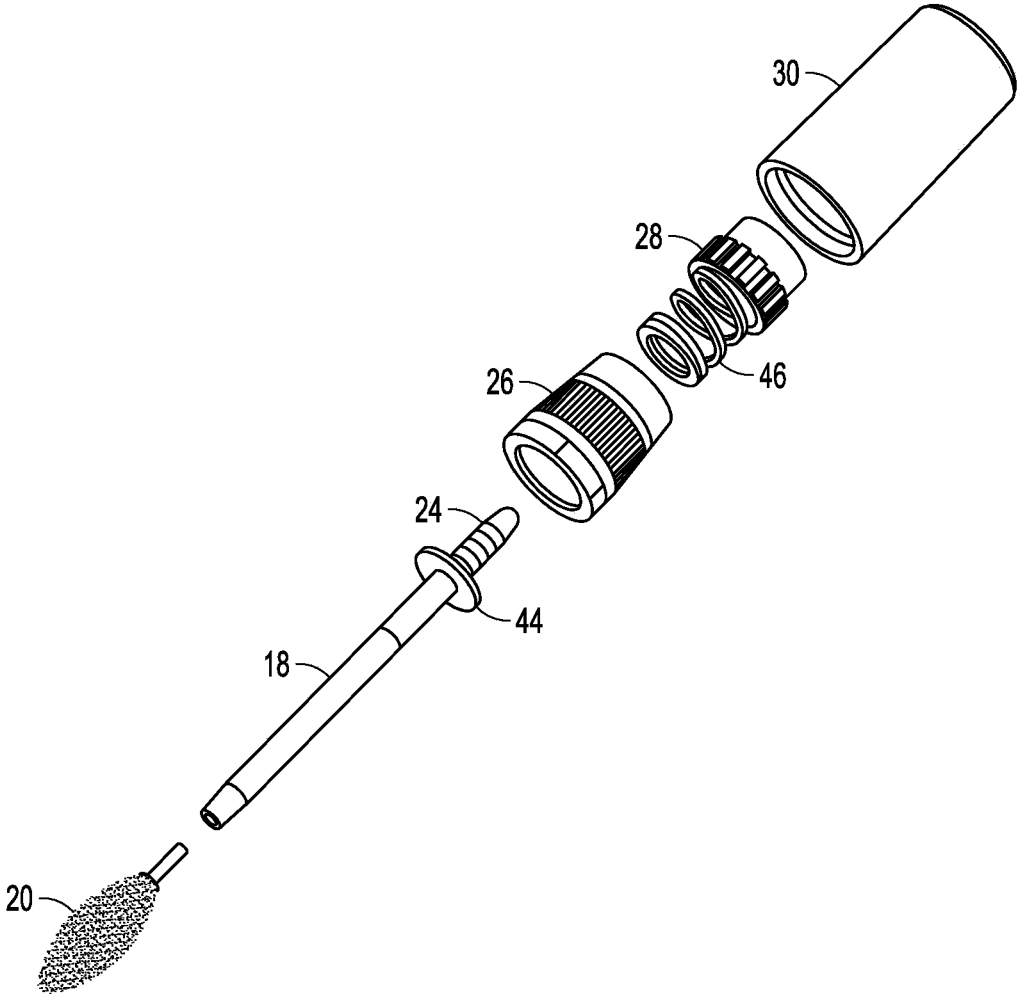
FIG. 6 is a perspective view exploded view of the applicator, wand, inner cap, push button and cap of the cosmetic reloadable system of FIG. 1.
Figure 7D:
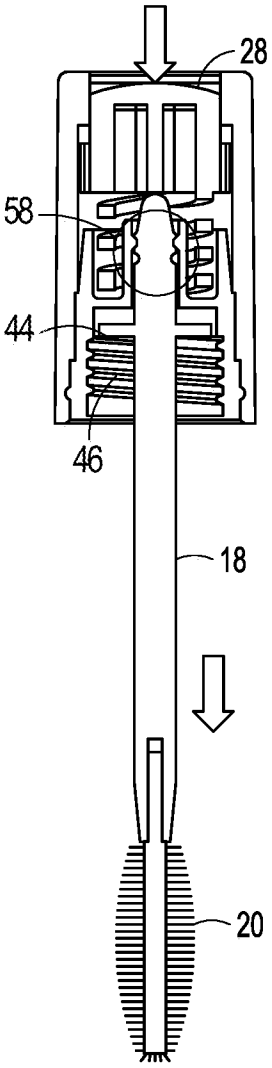
FIG. 7D is a cross sectional view of the applicator, wand, push button and cap of the cosmetic reloadable system of FIG. 1 in a pushed down position.

An exploded view of the cap 30 for the reloadable system 10 with a wand/rod 18 release mechanism is shown in FIG. 6. A rest position for the release mechanism is shown in FIG. 7A. The rest position is the position is employed by consumers to use the wand/rod 18 to apply a cosmetic. In the rest position, the wand/rod 18 is engaged by the inner cap, which is not shown in FIG. 7A and is within the cap 30. When push button 28 is pressed, the wand/rod 18 is disengaged and released from the cap 30, as shown in FIG. 7B.

Figure 7C:
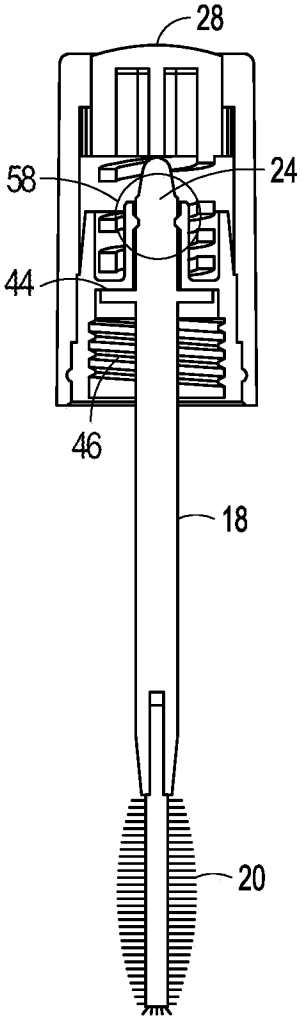
FIG. 7C is a cross sectional view of the applicator, wand, push button and cap of the cosmetic reloadable system of FIG. 1 in a rest position.
Figure 7B:
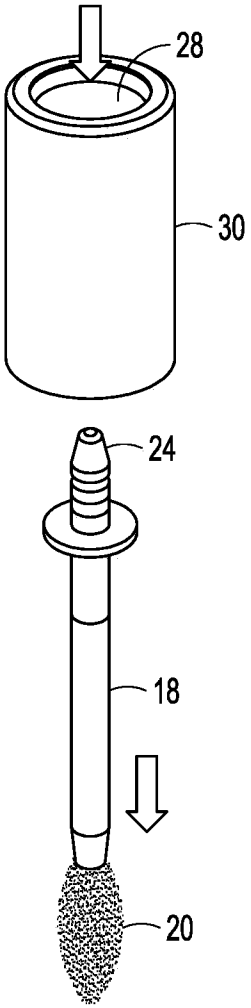
FIG. 7B is a perspective view of the applicator, wand, push button and cap of the cosmetic reloadable system of FIG. 1 in a pushed down position.
Figure 7A:
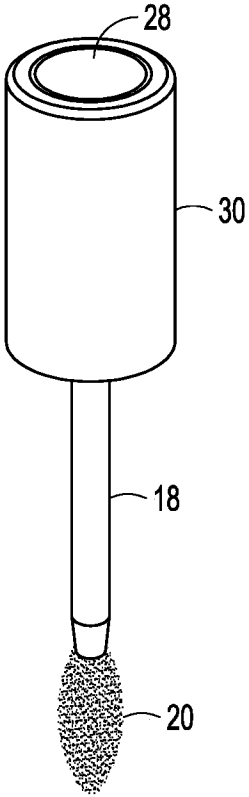
FIG. 7A is a perspective view of the applicator, wand, push button and cap of the cosmetic reloadable system of FIG. 1 in a rest position.
Figure 8:
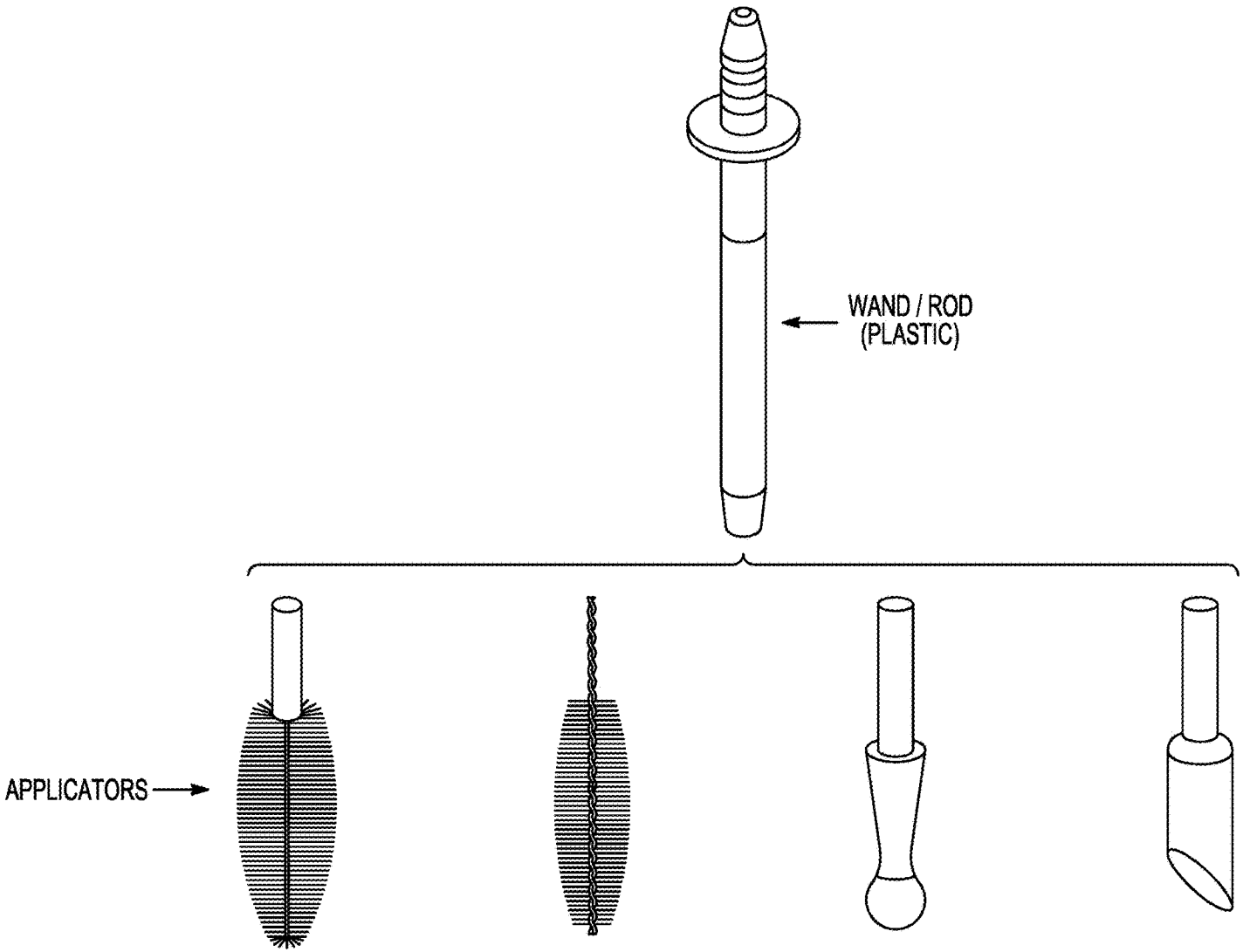
FIG. 8 is a perspective view of a molded brush applicator of the cosmetic reloadable system of FIG. 1; a perspective view of a twisted brush applicator of the cosmetic reloadable system of FIG. 1.; a perspective view of a ceramic brush applicator of the cosmetic reloadable system of FIG. 1. a perspective view of a doe-foot brush applicator of the cosmetic reloadable system of FIG. 1 for brush applications from left to right.

The rest position is shown in cross-section in FIG. 7C. The distal end 24 of the wand/rod 18 is snapped into the inner cap 26 when the distal end 24 is inserted into the inner cap 26. The wand/rod 18 is held in place by the inner cap 26. The distal end 24 of the wand/rod 18 includes a ring 44 and grooves 58, at least one of which is captured between the spring 29 and threads 46 of the inner cap 26. When the push button 28 is pressed down, as shown in FIG. 7D, the wand/rod 18 is unsnapped from the inner cap 26 and is released for replacement by a new wand/rod 18 and applicator 20.

The reloadable applicator system 10 is usable with a variety of applicators that include a molded brush, a twisted wire brush, a ceramic applicator, and a doe-foot applicator. When a wand/rod 18 applicator has been removed, a consumer simply inserts a clean applicator into the cap 30. With this arrangement, a consumer is not required to pull directly on the wand with a risk of getting product on his or her fingers.

The reloadable applicator system 10 is usable for applying mascara, lip gloss, liquid concealer, and liquid lip color.

All publications, patents and patent applications are incorporated herein by reference. While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

The invention claimed is:

1. A reloadable applicator, comprising:

a recyclable cartridge for containing a product;

a base sized to receive the recyclable cartridge;

a cartridge neck wiper including inner threads configured to engage with outer threads on the recyclable cartridge;

a wand comprising a proximal end and a distal end, the proximal end including an applicator for applying the product;

an inner cap attachable to the cartridge neck wiper, the inner cap configured to reversibly retain the distal end of the wand when the distal end of the wand is inserted into the inner cap, the inner cap including inner threads configured to engage with outer threads on the cartridge neck wiper;

a spring push button disposed in the inner cap, the spring push button including a spring positioned to retain the distal end of the wand when the wand is retained by the inner cap, the spring push button configured to release the distal end of the wand from the inner cap when the spring push button is pressed; and a cap configured to releasably retain the base, the cap being sized to surround the inner cap when the cap is retaining the base.

2. The reloadable applicator of claim 1, wherein the product is a cosmetic.

3. The reloadable applicator of claim 2, wherein the cosmetic includes mascara, lip gloss, liquid concealer, and liquid lip color.

4. The reloadable applicator of claim 1, wherein:

the recyclable cartridge has a distal end and a proximal end; and the distal end of the recyclable cartridge terminates in the outer threads.

5. The reloadable applicator of claim 1, wherein the cartridge neck wiper includes an open ended conical structure positionable within the recyclable cartridge.

6. The reloadable applicator of claim 5, wherein the open ended conical structure of the cartridge neck wiper is adjacent to the inner threads of the recyclable cartridge.

7. The reloadable applicator of claim 1, wherein the applicator is one of a molded brush, twisted wire brush, ceramic applicator, or doe foot applicator.

8. A reloadable applicator, comprising:

a cartridge for containing a product;

a base sized to receive the cartridge;

a cartridge neck wiper reversibly attachable to the cartridge;

a wand comprising a proximal end and a distal end, the proximal end including an applicator for applying the product;

an inner cap attachable to the cartridge neck wiper, the inner cap configured to reversibly retain the distal end of the wand when the distal end of the wand is inserted into the inner cap, the inner cap including inner threads configured to engage with outer threads on the cartridge neck wiper;

a spring push button disposed in the inner cap, the spring push button including a spring positioned to retain the distal end of the wand when the wand is retained by the inner cap, the spring push button configured to release the distal end of the wand from the inner cap when the spring push button is pressed; and a cap configured to releasably retain the base, the cap being sized to surround the inner cap when the cap is retaining the base.

9. The reloadable applicator of claim 8, wherein the cartridge is either replaceable or recyclable.

10. The reloadable applicator of claim 8, wherein the applicator is replaceable.

11. A reloadable applicator, comprising:

a recyclable cartridge for containing a product;

a base sized to receive the recyclable cartridge;

a cartridge neck wiper attached to the recyclable cartridge to form a single unit;

a wand comprising a proximal end and a distal end, the proximal end including an applicator for applying the product;

an inner cap attachable to the cartridge neck wiper, the inner cap configured to reversibly retain the distal end of the wand when the distal end of the wand is inserted into the inner cap, the inner cap including inner threads configured to engage with outer threads on the cartridge neck wiper;

a spring push button disposed in the inner cap, the spring push button including a spring positioned to retain the distal end of the wand when the wand is retained by the inner cap, the spring push button configured to release the distal end of the wand from the inner cap when the spring push button is pressed; and a cap configured to releasably retain the base, the cap being sized to surround the inner cap when the cap is retaining the base.

* * * * *